US008925745B2

(12) United States Patent
Theisen et al.

(10) Patent No.: US 8,925,745 B2
(45) Date of Patent: Jan. 6, 2015

(54) SHELF-TYPE DISPLAY MODULE

(71) Applicant: Target Brands, Inc., Minneapolis, MN (US)

(72) Inventors: Jennifer A. Theisen, Crystal, MN (US); William Y. Stafford, Minnetrista, MN (US); Erin L. Zobel, Minneapolis, MN (US); Timothy J. Martell, Brooklyn Park, MN (US); Benjamin Weshler, New York, NY (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/786,924

(22) Filed: Mar. 6, 2013

(65) Prior Publication Data

US 2014/0250749 A1 Sep. 11, 2014

(51) Int. Cl.

| | |
|---|---|
| ***A47F 1/04*** | (2006.01) |
| ***A47F 7/00*** | (2006.01) |
| ***A47F 5/08*** | (2006.01) |
| ***A47F 5/00*** | (2006.01) |
| ***A47B 43/00*** | (2006.01) |
| ***A47B 47/00*** | (2006.01) |
| ***A47B 57/00*** | (2006.01) |
| ***A47F 5/16*** | (2006.01) |
| ***A47F 1/12*** | (2006.01) |
| ***A47B 47/02*** | (2006.01) |
| ***A47B 57/58*** | (2006.01) |
| ***A47B 96/02*** | (2006.01) |

(52) U.S. Cl.

CPC ..... *A47F 5/0043* (2013.01); *A47F 5/16* (2013.01); *A47F 5/0025* (2013.01); *A47F 1/126* (2013.01); *A47B 47/022* (2013.01); *A47F 2005/165* (2013.01); *A47B 57/585* (2013.01); *A47B 96/027* (2013.01); *A47B 96/021* (2013.01)

USPC ..... 211/59.3; 211/88.01; 211/90.01; 211/119.003; 211/184; 211/193; 211/10

(58) Field of Classification Search

CPC ..... A47F 1/126; A47F 1/125; A47F 1/12; A47F 5/005; A47F 5/0062; A47F 5/0018; A47F 5/0025; A47F 5/0068; A47F 5/0081; A47F 5/0093; A47F 5/16; A47F 2005/165; A47F 7/28; A47F 57/42; A47F 57/52; A47F 57/58; A47F 57/583; A47F 57/585; A47F 57/588; A47F 47/022; A47F 47/021; A47F 96/061; A47F 96/027; A47F 96/02; A47F 96/021; A47F 96/025; B42F 17/08

USPC ..... 211/59.3, 59.2, 193, 90.01–90.04, 10, 211/11, 119.003, 184, 126.15, 134, 94.02, 211/126.1, 88.01; 108/143, 90; 312/126, 312/128, 132, 119

See application file for complete search history.

(56) References Cited

U.S. PATENT DOCUMENTS 1,978,636 A 10/1934 Keil
4,164,009 A 8/1979 Maguire, Jr. et al.

(Continued)

OTHER PUBLICATIONS

Office Action from Canadian Patent Application No. 2,811,284, mailed Sep. 9, 2013 (3 pages).

(Continued)

*Primary Examiner* — Jennifer E Novosad

(74) *Attorney, Agent, or Firm* — Leanne Taveggia Farrell; Westman, Champlin & Koehler, P.A.

(57) ABSTRACT

A shelf-type display module includes a carrier tray assembly including a carrier tray having a top, a bottom, a plurality of tracks and at least one light. The plurality of tracks protrude from the top of the carrier tray and the at least one light is mounted to the bottom of the carrier tray. An insert tray includes a main body having components for holding products for display and components for mating with the plurality of tracks on the carrier tray. The components of the main body that mate with the plurality of tracks on the carrier tray slide along the plurality of tracks from a right side to a left side of the carrier tray or from the left side to the right side of the carrier tray.

19 Claims, 11 Drawing Sheets

(56) References Cited

U.S. PATENT DOCUMENTS

| | | | | |
|---|---|---|---|---|
| 4,429,796 | A * | 2/1984 | Sussman | 211/11 |
| 4,747,025 | A | 5/1988 | Barton | |
| 4,762,235 | A | 8/1988 | Howard et al. | |
| 4,925,038 | A | 5/1990 | Gajewski | |
| 4,994,943 | A | 2/1991 | Aspenwall | |
| 5,011,018 | A * | 4/1991 | Keffeler | 206/532 |
| 5,012,936 | A * | 5/1991 | Crum | 211/59.3 |
| 5,085,154 | A | 2/1992 | Merl | |
| 5,088,607 | A | 2/1992 | Risafi et al. | |
| 5,265,735 | A * | 11/1993 | Hassel et al. | 211/11 |
| 5,330,063 | A * | 7/1994 | Remmers | 211/162 |
| 5,390,802 | A * | 2/1995 | Pappagallo et al. | 211/59.3 |
| 5,445,280 | A | 8/1995 | Rahn | |
| 5,611,442 | A | 3/1997 | Howard | |
| 5,626,243 | A | 5/1997 | Brozak, Jr. | |
| 5,626,246 | A | 5/1997 | Roddy et al. | |
| 5,657,880 | A * | 8/1997 | Birnbaum | 211/50 |
| 5,673,801 | A | 10/1997 | Markson | |
| 5,690,415 | A | 11/1997 | Krehl | |
| 5,746,328 | A | 5/1998 | Beeler et al. | |
| 5,758,585 | A | 6/1998 | Latchinian | |
| 6,041,720 | A | 3/2000 | Hardy | |
| 6,082,557 | A | 7/2000 | Leahy | |
| 6,357,606 | B1 | 3/2002 | Henry | |
| 6,364,136 | B1 * | 4/2002 | Weshler et al. | 211/90.02 |
| 6,364,273 | B1 | 4/2002 | Otema | |
| 6,409,027 | B1 * | 6/2002 | Chang et al. | 211/59.3 |
| 6,431,721 | B2 | 8/2002 | Shemitz et al. | |
| 6,484,891 | B2 | 11/2002 | Burke | |
| 6,571,498 | B1 | 6/2003 | Cyrluk | |
| 6,827,465 | B2 | 12/2004 | Shemitz et al. | |
| 6,883,671 | B2 | 4/2005 | Rushing | |
| 7,131,543 | B2 | 11/2006 | Mason | |
| 7,163,305 | B2 | 1/2007 | Bienick | |
| 7,308,987 | B2 | 12/2007 | Richardson et al. | |
| 7,434,951 | B2 | 10/2008 | Bienick | |
| 7,574,822 | B1 | 8/2009 | Moore | |
| 7,591,382 | B2 * | 9/2009 | Brock | 211/10 |
| 7,628,525 | B2 * | 12/2009 | Lee et al. | 362/602 |
| 7,824,055 | B2 | 11/2010 | Sherman | |
| 7,882,969 | B2 * | 2/2011 | Gerstner et al. | 211/119.003 |
| 7,909,183 | B2 | 3/2011 | Oh | |
| 7,913,861 | B2 * | 3/2011 | Mueller et al. | 211/59.3 |
| 7,992,728 | B2 * | 8/2011 | Burgess et al. | 211/94.01 |
| 8,087,522 | B2 * | 1/2012 | Stafford et al. | 211/119.003 |
| 8,215,795 | B2 | 7/2012 | Pichel | |
| 8,443,988 | B2 * | 5/2013 | Niederhuefner | 211/59.3 |
| 8,646,935 | B2 * | 2/2014 | Karan | 362/125 |
| 8,763,819 | B2 * | 7/2014 | Theisen et al. | 211/71.01 |
| 2001/0010302 | A1 * | 8/2001 | Nickerson | 211/59.3 |
| 2004/0118795 | A1 * | 6/2004 | Burke | 211/59.3 |
| 2004/0226203 | A1 | 11/2004 | Yenglin et al. | |
| 2006/0048419 | A1 | 3/2006 | Yenglin et al. | |
| 2006/0049122 | A1 * | 3/2006 | Mueller et al. | 211/59.3 |
| 2007/0068885 | A1 * | 3/2007 | Busto et al. | 211/59.3 |
| 2007/0108142 | A1 * | 5/2007 | Medcalf et al. | 211/59.3 |
| 2007/0138114 | A1 * | 6/2007 | Dumontet | 211/59.3 |
| 2007/0272634 | A1 * | 11/2007 | Richter et al. | 211/59.3 |
| 2008/0121146 | A1 * | 5/2008 | Burns et al. | 108/23 |
| 2010/0258513 | A1 * | 10/2010 | Meyer et al. | 211/59.3 |
| 2011/0100941 | A1 | 5/2011 | Luberto et al. | |
| 2011/0100942 | A1 | 5/2011 | Spizman et al. | |
| 2011/0174750 | A1 | 7/2011 | Poulokefalos | |
| 2011/0204009 | A1 | 8/2011 | Karan | |
| 2011/0315645 | A1 | 12/2011 | Fadrowski | |
| 2012/0012547 | A1 | 1/2012 | Bergdoll et al. | |

OTHER PUBLICATIONS

Office Action from Canadian Patent Application No. 150,458, mailed Jun. 17, 2014 (1 page).

Office Action from Canadian Patent Application No. 156,840, mailed Jun. 11, 2014 (1 page).

* cited by examiner

SHELF-TYPE DISPLAY MODULE

BACKGROUND

Retail stores use a variety of display fixtures to present products to customers for purchase. These display fixtures can support the product, indicate the product price and include signage, graphics and lighting for highlighting the product. Exemplary display structures include shelves, trays, racks, peg hooks and other similar structures.

The discussion above is merely provided for general background information and is not intended to be used as an aid in determining the scope of the claimed subject matter.

SUMMARY

A shelf-type display module includes a carrier tray assembly including a carrier tray having a top, a bottom, a plurality of tracks and at least one light. The plurality of tracks protrude from the top of the carrier tray and the at least one light mounted to the bottom of the carrier tray. An insert tray includes a main body having components for holding products for display and components for mating with the plurality of tracks on the carrier tray. The components of the main body that mate with the plurality of tracks on the carrier tray slide along the plurality of tracks from a right side to a left side of the carrier tray or from the left side to the right side of the carrier tray.

The shelf-type display module includes a base assembly having a base for supporting product in a retail store and a detachable front assembly. The detachable front assembly includes a main body detachably mounted to a front of the base, a fanfold extrusion housed in the main body of the detachable front assembly and a cover rotatably coupled to the main body. The fanfold extrusion includes at least two label sleeves for receiving labels that provide relevant information to employees about the products being supported by the base. The cover encloses the fanfold extrusion within the main body and including a lens mounted to a lens back plate. A graphic is sandwiched between the lens and the lens back plate and provides relevant information to customers about the products being supported by the base.

A method of assembling a shelf-type display module includes obtaining a carrier tray having a top, a bottom and a set of tracks that protrude from the top of the carrier tray. The insert tray is side-loaded onto the carrier tray. The insert tray includes a main body having components for displaying products and components for engaging with the set of tracks on the carrier tray.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The display modules described below are shelf-type display structures that when mounted together on a wall of a gondola display unit form a display fixture. Each display module includes the same base component and a select one of a plurality of alternative trays that is mounted to the base component to form the display module. Each display module aids in the display of retail products, such as beauty supplies. Exemplary beauty supplies include nail polish, lipsticks, lip glosses, eye shadows, rouge, bronzers, make-up bases and powders, lotions and etc.

More specifically, each display module includes a carrier tray assembly and an insert tray. The carrier tray assembly includes a carrier tray, a pair of shelf brackets and a detachable front assembly. The detachable front assembly retains various components that hold and display labels that provide relevant information to employees about the products being supported by the carrier tray assembly. The insert tray mounts to the carrier tray of the carrier tray assembly and can be selected from a plurality of different insert trays depending on the product or products that need to be displayed.

Figure 1:
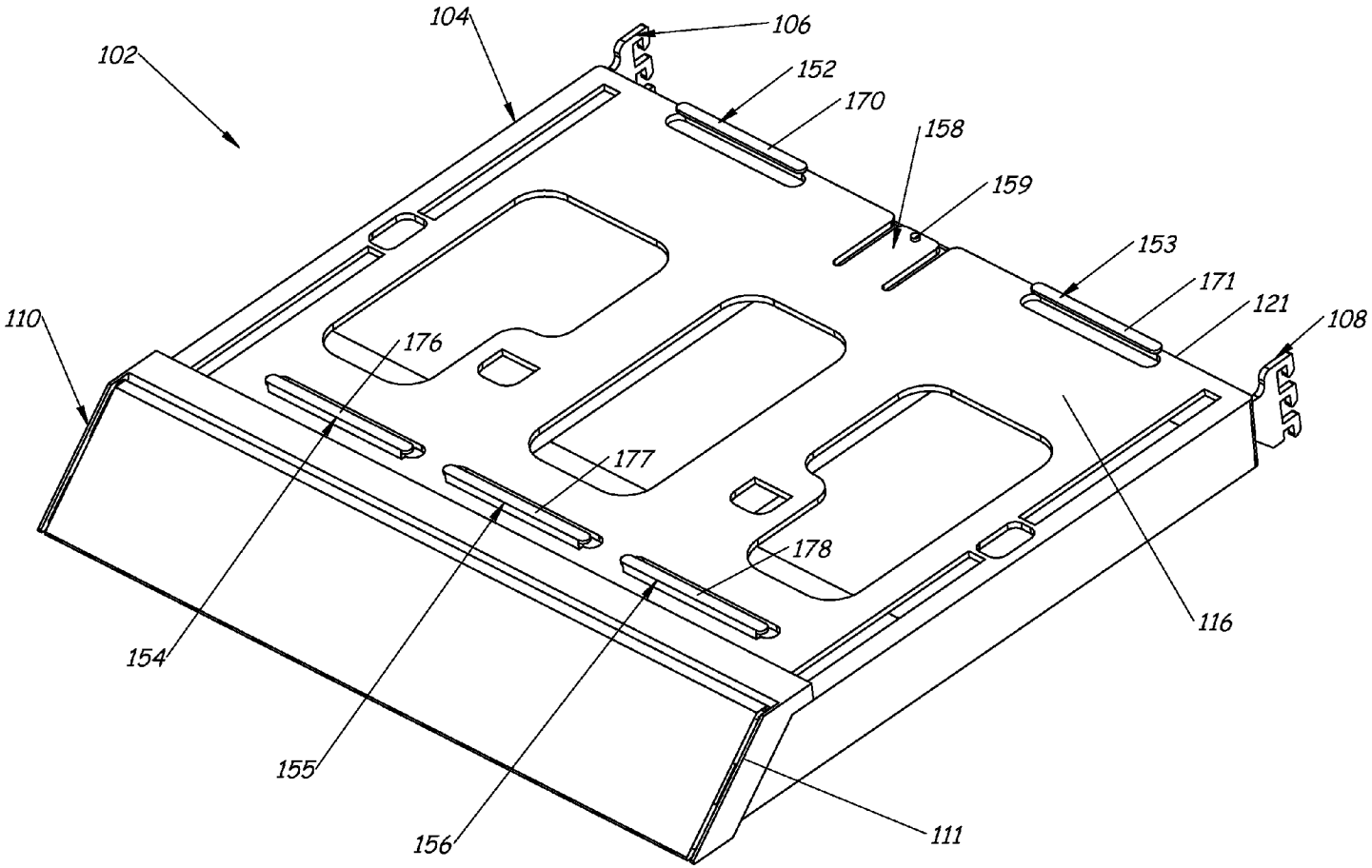
FIG. 1 is a perspective view of a carrier tray assembly or base assembly according to one embodiment.
Figure 2:
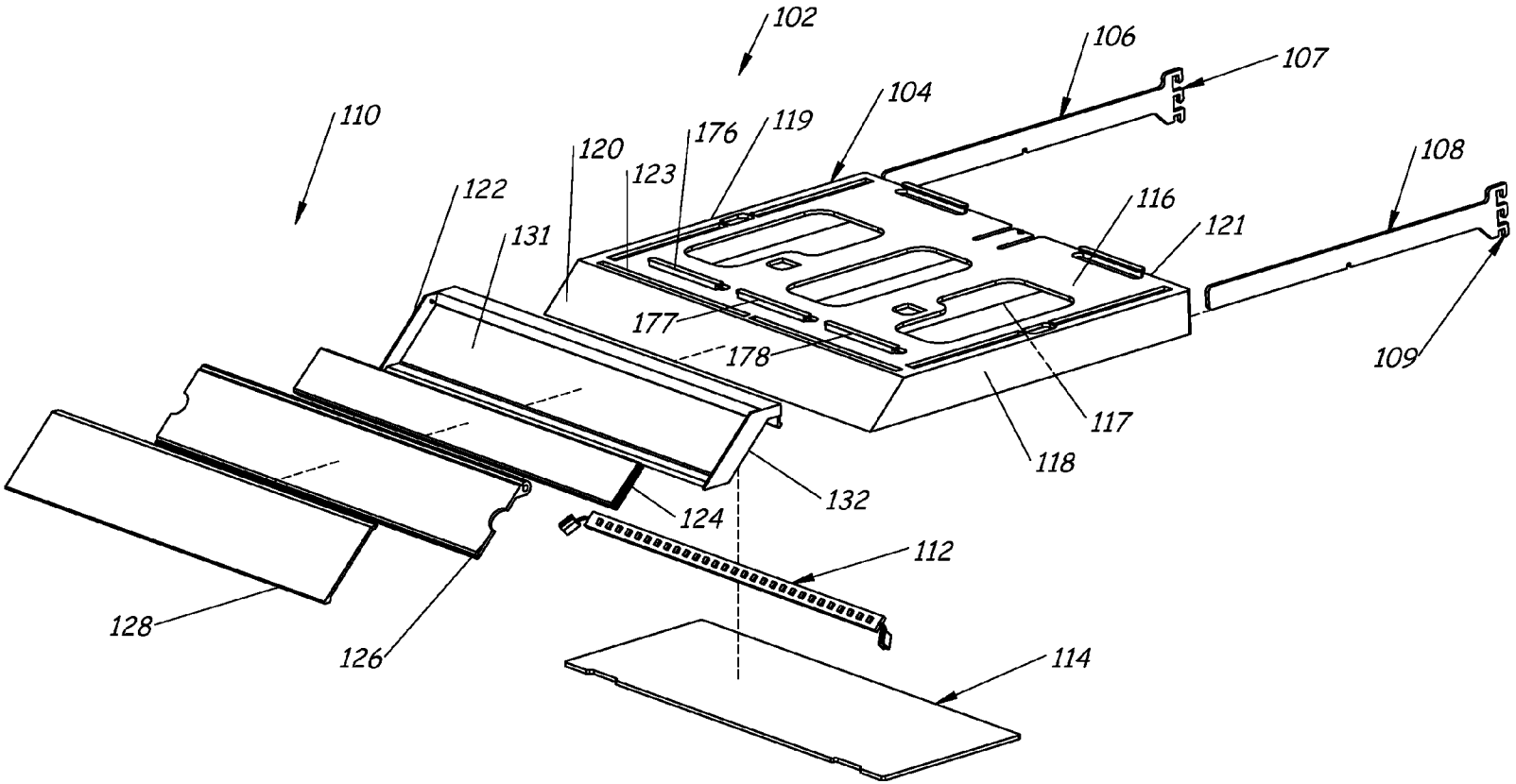
FIG. 2 is an exploded perspective view of the carrier tray assembly or base assembly illustrated in FIG. 1.

FIG. 1 is a perspective view of a carrier tray assembly or base assembly 102 according to one embodiment. FIG. 2 illustrates an exploded perspective view of carrier tray assembly or base assembly 102 illustrated in FIG. 1. Carrier tray assembly 102 includes a carrier tray or base 104, a pair of shelf brackets or arms 106 and 108, a detachable front assembly 110, a plurality of lights 112 (such as a LED lighted strip assembly) and a diffuser 114. Carrier tray 104 can be plastic injection molded using a polymer, such as an opaque styrene. Carrier tray 104 provides a support structure having a top 116, a bottom 117, a right side 118, a left side 119, a front 120 and a back 121. Carrier tray 104 provides structural elements for holding and retaining the pair of shelf brackets 106 and 108, detachable front assembly 110, the plurality of lights 112 and diffuser 114.

For example, the pair of shelf brackets 106 and 108 can be made of a conductive material, such as metal, and mounted within carrier tray 104 so that a portion of shelf brackets 106 and 108, which have a plurality of fingers 107 and 109 that extend backward from back 121, are configured to attach to concealed standards on a powered back panel that couples to a wall of a gondola display unit. More particularly, fingers 107 and 109 not only mechanically attach carrier tray assembly 102 to the concealed standards on the powered back panel, but fingers 107 and 109 also electrically connect with the concealed standards on the powered back panel. Behind fascia panels on the powered back panel includes circuitry and wiring for conducting electricity. Upon making the appropriate electrical connection, the pair of shelf brackets complete a circuit designed to power the plurality of lights 112. In particular, one end of lights 112 is electrically connected to bracket 106 and the other end of lights 112 is electrically connected to bracket 108 such that current flows between bracket 106 and bracket 108 through lights 112 causing lights 112 to product light. Carrier tray 104 acts as an insulator and does not conduct electricity between bracket 106 and bracket 108. The plurality of lights 112 are coupled to bottom 117 of carrier tray 104 and are covered by diffuser 114, which is also attached to bottom 117 of carrier tray 104. In this way, the plurality of lights 112 not only cast light downward through diffuser 114 to illuminate products being supported by the carrier tray assemblies located below, but can also cast light upward and through at least a portion of detachable front assembly 110 when detachable front assembly 110 is attached to front 120 of carrier tray 104.

Figure 4:
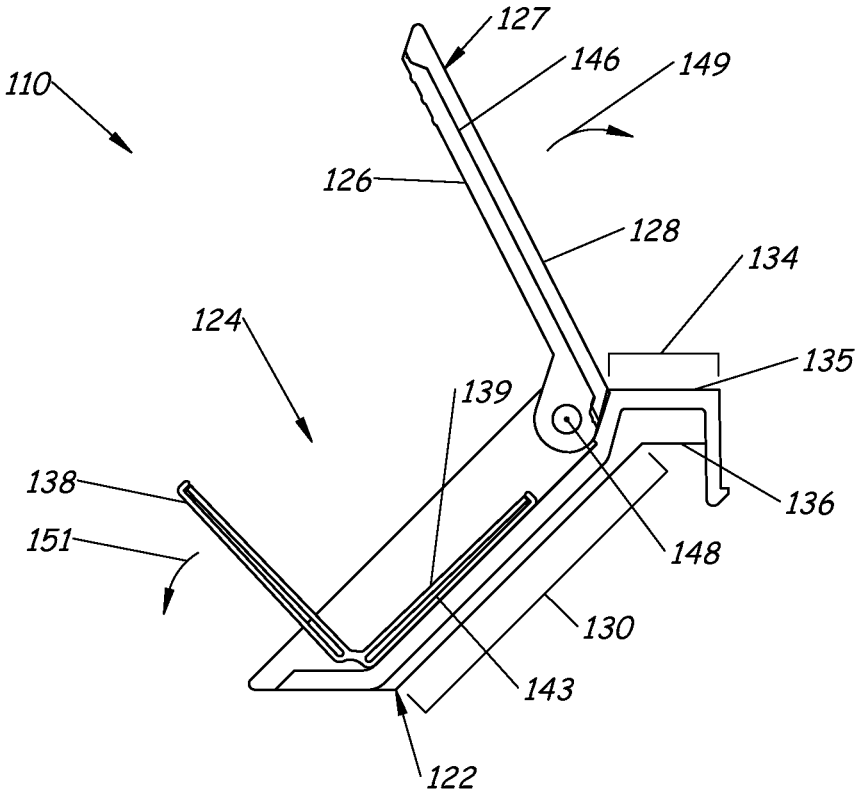
FIG. 4 is a side view of a detachable front assembly of the carrier tray assembly or base assembly illustrated in FIGS. 1 and 2 with a cover and a fanfold extrusion in open positions.

Detachable front assembly 110 includes a main body 122, a fanfold extrusion 124, a lens back plate 126 and a lens 128. Main body 122 mounts to front 120 of carrier tray 104 and can be plastic injection molded using a polymer, such as styrene. It should be noted that components on carrier tray 104 that receive the detachable components on detachable front assembly 110 are not illustrated. Like front 120 of carrier tray 104, main body 122 includes an angled component 130 (FIG. 4) having a front 131 and a back 132. Back 132 of angled component 130 mates with front 120 of carrier tray 104. In addition, main body 122 includes an upper component 134 (FIG. 4) having a top 135 (FIG. 4) and a bottom 136 (FIG. 4). Bottom 136 mates with a portion of top 116 of carrier tray 104. More particularly, upper component 134 of main body 122 is made of a transparent material, such as clear styrene. Light from the plurality of lights 112 casts through an opening 123 or openings in carrier tray 104 and is then allowed to filter through upper component 134 to illuminate a portion of the top of carrier tray 104.

Figure 3:
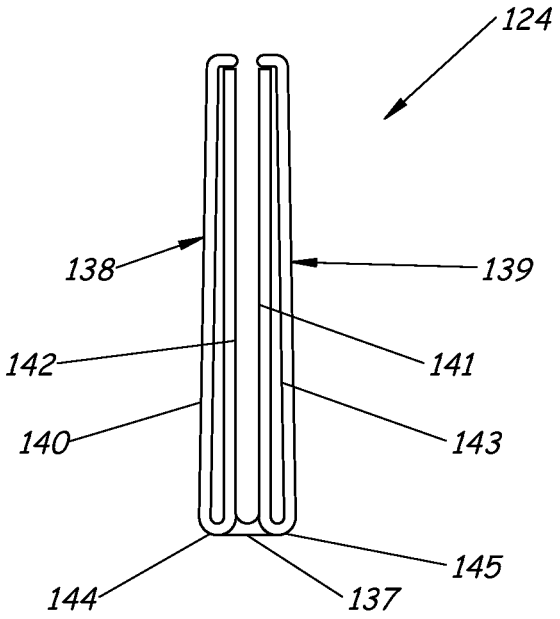
FIG. 3 is an enlarged side view of a fanfold extrusion of the carrier tray assembly or base assembly illustrated in FIGS. 1 and 2.

FIG. 3 illustrates a side view of fanfold extrusion 124. Fanfold extrusion 124 is made of a single, continuous and extruded polymer, such as a transparent polyvinyl chloride, and includes first and second label sleeves 138 and 139 coupled together by a hinge 137. Each label sleeve 138 and 139 includes a front piece 140 and 141 coupled to a back piece 142 and 143 by a bottom connecting piece 144 and 145. As illustrated in FIG. 3, front piece 140 of first label holder 138 has a substantially identical shape to back piece 143 of second label holder 139, however, back piece 143 of second label holder 139 is arranged such that it minors front piece 140 of first label holder 138. Likewise, front piece 141 of second label holder 139 is arranged such that it minors back piece 142 of first label holder 138. In other words, the material of fanfold extrusion 124 extends along front piece 140 of label sleeve 138, turns at bottom connecting piece 144 and extends along back piece 142 of label sleeve 138 such that bottom connecting piece 144 encloses the bottom of first sign sleeve 138 and the tops of front piece 140 and back piece 142 bias together to hold a label in place. The material of fanfold extrusion 124 also extends along back piece 143 of label sleeve 139, turns at bottom connecting piece 145 and extends along front piece 141 of label sleeve 139 such that bottom connecting piece 145 encloses the bottom of second sign sleeve 139 and the tops of front piece 141 and back piece 143 bias together to hold a label in place. Still further and as discussed above, the single, continuous material of fanfold extrusion 124 includes hinge 137, which connects bottom connecting piece 144 of label sleeve 138 to bottom connecting piece 145 of label sleeve 139.

Together, lens back plate 126 and lens 128 provide a cover 127 (FIG. 4) to main body 122 so as to enclose and hide fanfold extrusion 124 from public view. Lens back plate 126 can be made of an injection molded plastic, such as an opaque styrene and lens 128 can be made of an injection molded plastic, such as a transparent NAS (a copolymer of polystyrene and acrylic). Lens 128 is mounted to lens back plate 126 and sandwiched between them is a graphic 146 (FIG. 4). Graphic 146 provides relevant information to customers about the products that are being displayed on carrier tray assembly 102 including, for example, brand name, product type, and illustrations of product colors and color names.

FIG. 4 illustrates a side view of detachable front assembly 110 in an open position with the end cap 111 (FIG. 1) removed for purposes of clarity. As illustrated, back piece 143 of fanfold extrusion 124 is attached to front 131 (FIG. 2) of angled component 130. For example, back piece 143 of fanfold extrusion can be attached to front 131 of angled component 130 using an adhesive. In addition, cover 127 is rotatably mounted to detachable front 122 (FIG. 2) about a proximal end or axis 148 and a distal end of cover 127 is a free end. Therefore and as illustrated by directional arrow 149 in FIG. 4, the labels in fanfold extrusion 124 are accessed by first rotating cover 127 about proximal end or axis 148. Although not illustrated in FIG. 4, in this open position, the labels located in label sleeve 138 are viewable and scannable. In one embodiment, the labels located in label sleeve 138 provide relevant information to employees about the products that carrier tray assembly 102 is displaying including, for example, a price, a product description identifier, such as a DPCI (Department Class Item) number and associated bar codes. The labels located in label sleeve 139 are then accessed by rotating label sleeve 138 about hinge 140 as illustrated in FIG. 4 by directional arrow 151. In this open position, the labels located in label sleeve 139 are viewable and scannable. The labels in label sleeve 139 also provide relevant information to employers about the products that carrier tray assembly 102 is displaying including, for example, a price, a product description identifier, such as a DPL number and associated bar codes. In one embodiment, two label sleeves 138 and 139 are included in order to fit all of the separate labels for describing product supported by carrier tray 104. However, it should be realized that any number of label sleeves in fanfold extrusion 124 are possible.

Figure 5:
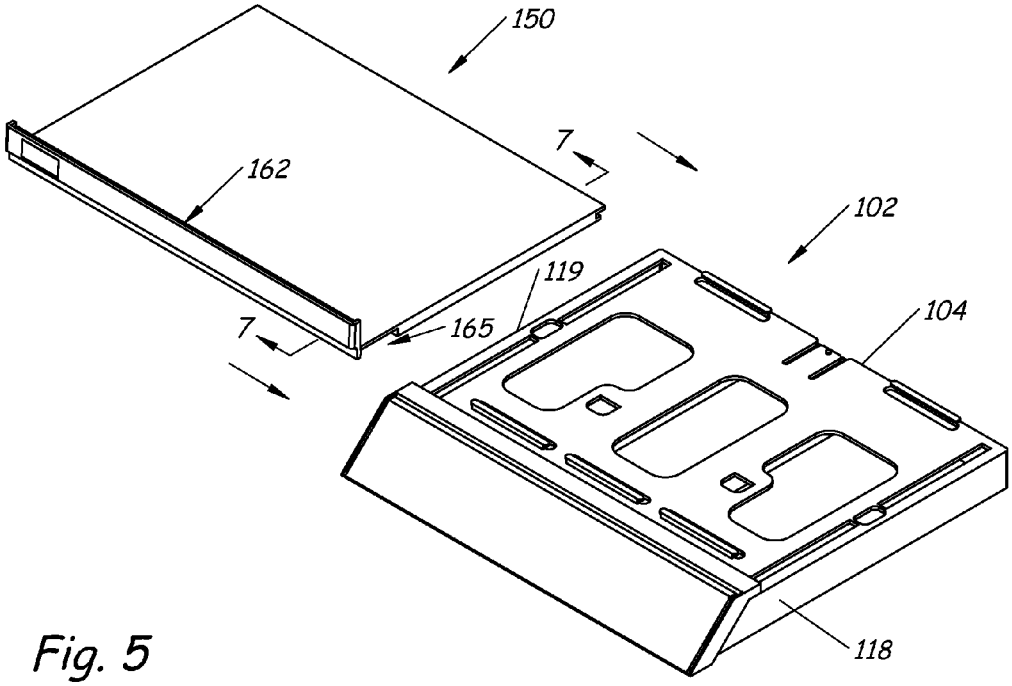
FIG. 5 is a perspective view of mounting one embodiment of an insert tray to the carrier tray assembly or base assembly illustrated in FIGS. 1 and 2.

FIG. 5 illustrates a perspective view of mounting one embodiment of an insert tray 150 to carrier tray assembly 102. As illustrated in the FIG. 6 perspective view, after insert tray 150 is mounted to carrier tray assembly 102, the combination of carrier tray assembly 102 and insert tray 150 comprises a shelf-type display module 100. As illustrated, insert tray 150 can be mounted onto carrier tray assembly 102 by sliding insert tray 150 in the direction illustrated by arrows in FIG. 5. In other words, insert tray 150 can be mounted to carrier tray assembly 102 by sliding insert tray 150 from left side 119 to right side 118 on carrier tray 104. Although not specifically illustrated, in the alternative, insert tray 150 can be mounted to carrier tray assembly 102 by sliding insert tray 150 in a direction opposite of the directional arrows illustrated in FIG. 5. In other words, insert tray 150 can be mounted to carrier tray assembly 102 by sliding insert tray 150 from right side 118 to left side 119 on carrier tray 104.

With reference back to FIG. 1, to mount insert tray 150 to carrier tray assembly 102, carrier tray 104 includes additional components for receiving and securing insert tray 150. In one embodiment, carrier tray 104 includes a plurality of tracks protruding from top 116. In particular, carrier tray 104 includes a first set of tracks 152 and 153 spaced apart and positioned in alignment with each other. In particular, the first set of tracks 152 and 153 are spaced apart across a width of carrier tray 104 and are located near back 121 of carrier tray 104. Carrier tray 104 also includes a second set of tracks 154, 155 and 156 spaced apart and positioned in alignment with each other. In particular, second set of tracks 154, 155, and 156 are spaced apart across a width of carrier tray 104 and are located near front 120 (FIG. 2) of carrier tray 104. Tracks 152, 153, 154, 155 and 156 extend from top 116 of carrier tray and are an inverted "L" shape. In other words, one of the ends of each track's "L" shape is fixed to top 116 of carrier tray 104 and the other of the ends of each track's "L" shape are free. Tracks 152, 153, 154, 155 and 156 are configured to engage with and receive corresponding mating components on an insert tray, such as insert tray 150.

In another embodiment, carrier tray includes a flexible tab 158 having a nub 159 that protrudes upwards from an upper surface of flexible tongue 158. Flexible tongue 158 is formed integrally with the material of carrier tray 104 and is defined by a continuous slit that is formed on three sides. With three free edges, flexible tongue 158 is capable of being depressed, and when released, capable of springing back into its original position.

Figure 7:
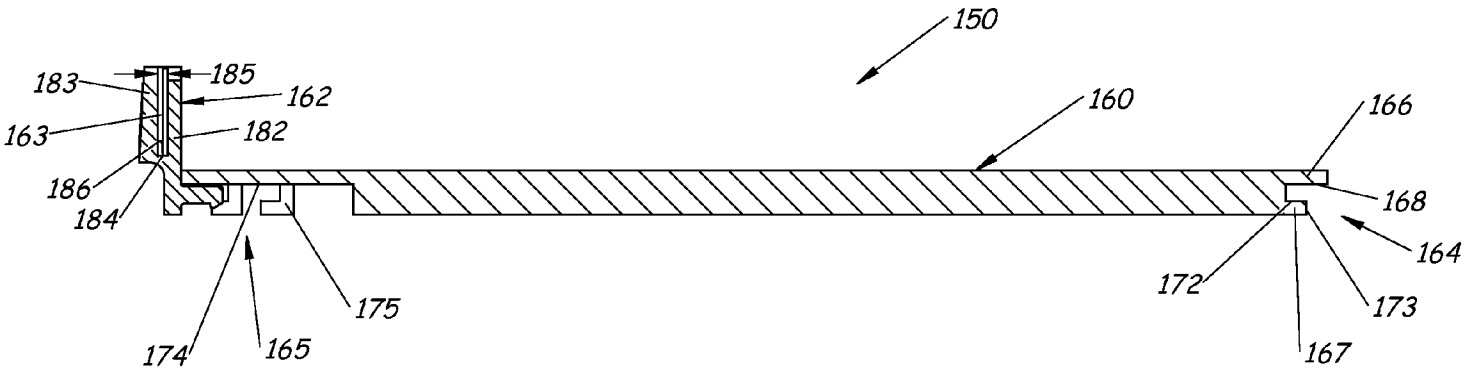
FIG. 7 is a section view of the insert tray taken through a section line indicated in FIG. 5.

FIG. 7 illustrates a section view of insert tray 150 taken along the line indicated in FIG. 5. Insert tray 150 is a flat insert tray that has a main body 160 that can be fabricated by, for example, injection molding opaque colored styrene. Fastened to a front of insert tray 150 is a label holder 162 that can also be made by injection molding, but using, for example, transparent styrene. While carrier tray assembly 102 includes fanfold extrusion 124 having label sleeves 138 and 139 that both hold the labels and hide the labels from customer view by being encased between main body 122 and cover 127, the labels located in label holder 162 are viewable by the customer at all times. In one embodiment, multiple products can be supported on insert tray 150 and therefore carrier tray 104 that are of the same brand and have the same price, but have different characteristics. For example, bottles of nail polish may be displayed on insert tray 150 that are of the same brand and size and include the same price per product; however, the bottles of nail polish can be of an assortment of different colors. Each color requires a separate label that includes product item numbers for access by store employees to perform inventory or stocking related activities. However, in some embodiments, only one label or a few labels needs to be viewable at all times that relays price information to the customer about the product. This label or labels 163 can be placed in label holder 162. In addition, temporary in-store marketing signs can also be placed within label holder 162 for when the products being displayed on insert tray 150 are undergoing a promotional incentive, such as undergoing a promotional price.

Figure 8:
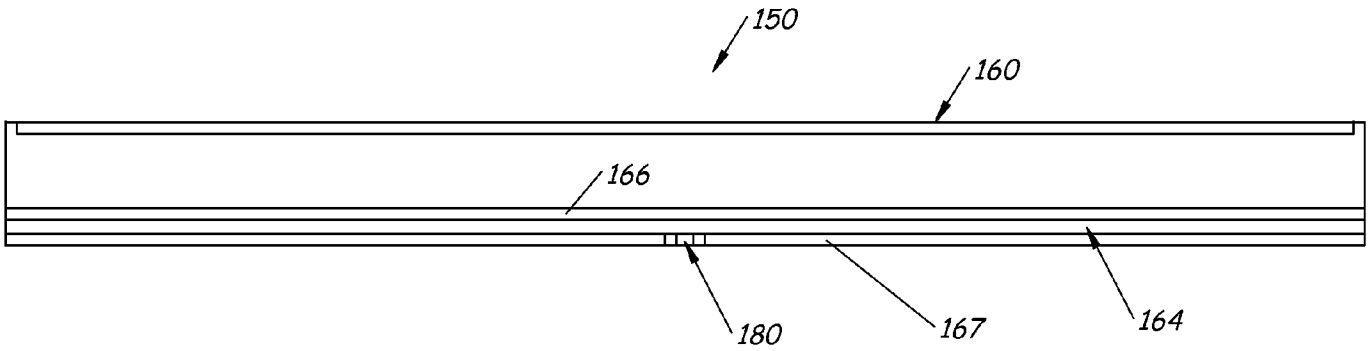
FIG. 8 is a back elevation view of the insert tray illustrated in FIG. 5.

Main body 160 of insert tray 150 also includes components for mating with tracks 152, 153, 154, 155 and 156 on carrier tray 104. In particular and as also illustrated in the back elevation view of FIG. 8, main body 160 of insert tray 150 includes a rear channel 164 that extends an entire width of insert tray 150 and a front channel 165 that extends at least a portion of an entire width of insert tray 150.

Rear channel 164 is defined by an upper leg 166 and a lower leg 167. Upper leg 166 is deeper in dimension than lower leg 167 and when insert tray 150 is being mounted to carrier tray 104, a bottom surface 168 of upper leg 166 slides along and engages top surfaces 170 and 171 (FIG. 1) of tracks 152 and 153. Furthermore, when insert tray 150 is being mounted to carrier tray 104, a top surface 172 and an end surface 173 of lower leg 167 slides along and engages under surfaces of tracks 152 and 153. Front channel 165 is defined by a bottom 174 of main body 160 and an L-shaped leg or legs 175 that protrude from bottom 174. When insert tray 150 is being mounted to carrier tray 104, bottom 174 slides along and engages top surfaces 176, 177 and 178 (FIG. 1) of tracks 154, 155 and 156. Furthermore, when insert tray 150 is being mounted to carrier tray 104, select surfaces of L-shaped leg or legs 175 slide along and engage under surfaces of tracks 154, 155 and 156.

Insert tray 150 also includes an indentation 180 (FIG. 8) in lower leg 167. Indentation 180 is located at a midpoint along the back lower leg 167 and is recessed a depth from the back of insert tray 150 into lower leg 167. Indentation 180 is configured to mate with nub 159 on flexible tongue 158 of carrier tray 104. Upon insert tray 150 sliding along tracks 152, 153, 154, 155 and 156, the flexible nature of tongue 158 allows nub 159 to also ride along insert tray 150 until indentation 180 engages with nub 159 and locks insert tray 150 to carrier tray 104. To release insert tray 150, nub 159, and therefore tongue 158, is depressed and insert tray 150 is again allowed to ride along tracks 152, 153, 154, 155 and 156 and be removed from carrier tray 104.

Figure 6:
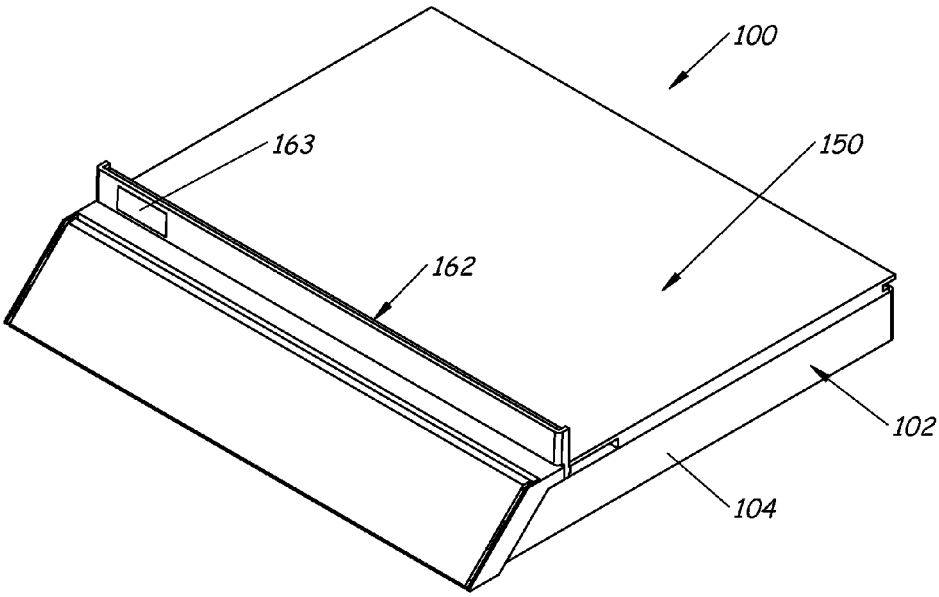
FIG. 6 is a perspective view of one embodiment of a shelf-type display module including the insert tray of FIG. 5 mounted to the carrier tray assembly or base assembly illustrated in FIGS. 1 and 2.

Label holder 162 (FIGS. 5-7) of insert tray 150 includes a back component 182 connected to a front component 183 (FIG. 7) by a bottom connecting piece 184 (FIG. 7) to define a slot. Back component 182, front component 183 and bottom connecting piece 184 (and therefore also the slot) extend almost the entire width of insert tray 150 as illustrated in FIGS. 5 and 6. Bottom connecting piece 184 encloses the bottom of the slot of the label holder 162, while a distance 185 of the slot is between back component 182 and front component 183 provides an opening in the top of label holder 162 for label(s) 163 to slide into label holder 162. In addition, label holder 162 includes a plurality of ramps 186 (FIG. 7) located in the slot that are spaced apart from each other along the width of label holder 162. Each ramp 186 includes an arc that extends from an inner surface of front component 183 to an inner surface of bottom connecting piece 184. As such, when label(s) 163 is inserted into the opening in the slot, the bottom edge of the label(s) 163 rides along the arc of a ramp 186 to engage and be held by the inner surface of bottom connecting piece 184 and between ramps 186 and an inner surface of back component 182.

Figure 9:
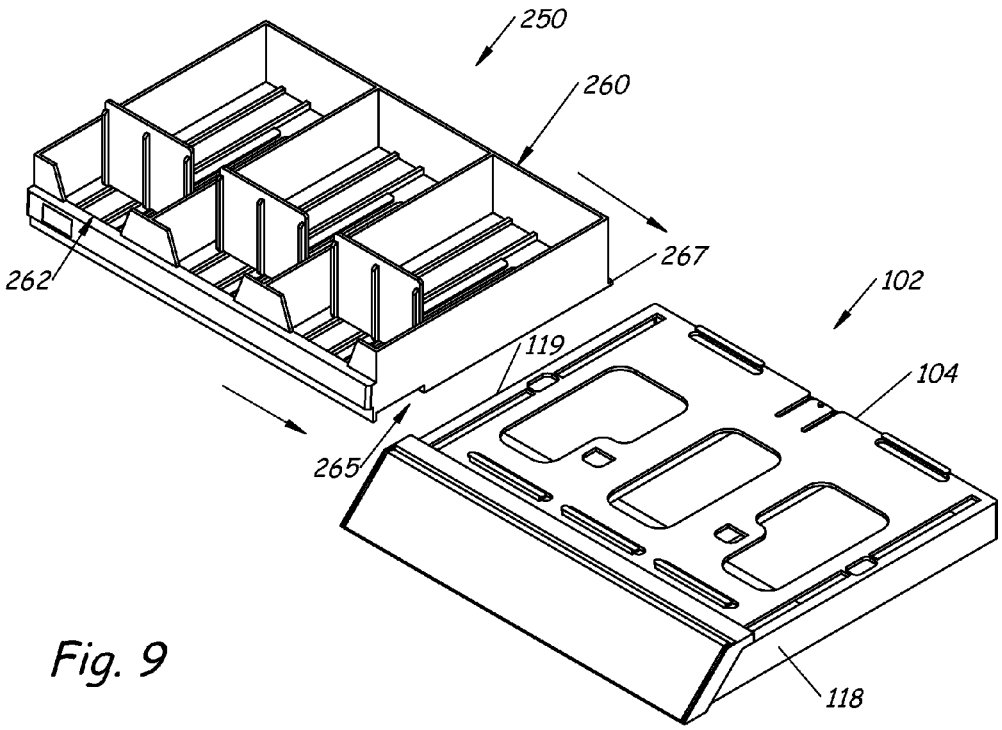
FIG. 9 is a perspective view of mounting another embodiment of an insert tray to the carrier tray assembly or base assembly illustrated in FIGS. 1 and 2.
Figure 10:
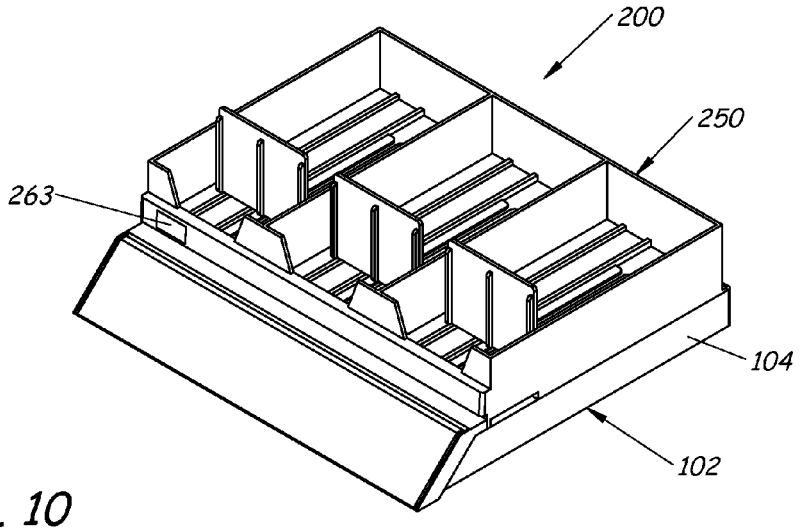
FIG. 10 is a perspective view of another embodiment of a shelf-type display module including the insert tray of FIG. 9 mounted to the carrier tray assembly or base assembly illustrated in FIGS. 1 and 2.

FIG. 9 illustrates a perspective view of mounting another embodiment of an insert tray 250 to carrier tray assembly 102. As illustrated in the FIG. 10 perspective view, when insert tray 250 is mounted to carrier tray assembly 102, the combination of carrier tray assembly 102 and insert tray 250 is a display fixture 200. As illustrated, insert tray 250 can be mounted to carrier tray assembly 102 by sliding insert tray 250 in the direction illustrated by arrows in FIG. 9. In other words, insert tray 250 can be mounted to carrier tray assembly 102 by sliding insert tray 250 from left side 119 to right side 118 on carrier tray 104. Although not specifically illustrated, in the alternative, insert tray 250 can be mounted to carrier tray assembly 102 by sliding insert tray 250 in a direction opposite of the directional arrows illustrated in FIG. 9. In other words, insert tray 250 can be mounted to carrier tray assembly 102 by sliding insert tray 250 from right side 118 to left side 119 on carrier tray 104.

Figure 11:
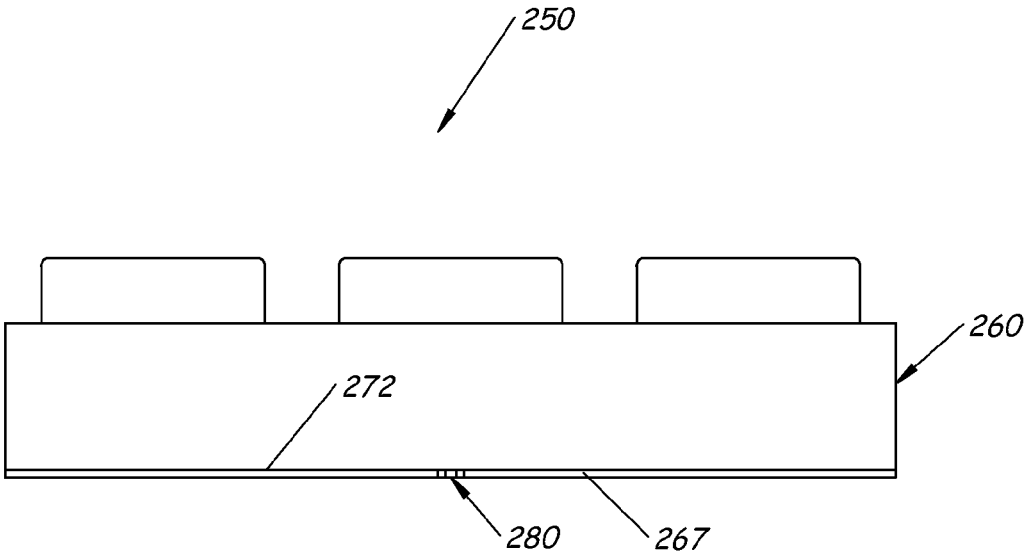
FIG. 11 is a back elevation view of the insert tray illustrated in FIG. 9.

Insert tray 250 is a pusher tray and includes a main body 260 that can be fabricated by injection molding transparent styrene. Main body 260 includes components for holding product for display and for mating with tracks 152, 153, 154, 155 and 156 on carrier tray 104. While insert tray 250 illustrates three channels each having a pusher mechanism for pushing product forward, pusher trays can come in various configurations including four or more channels each having a pusher mechanism. Insert tray 250, including other configurations of pusher trays, includes a label holder 262. In addition, main body 260 of insert tray 250 includes a lip or leg 267 (as illustrated in the back elevation view of FIG. 11) that extends an entire width of the back side of insert tray 250 and a front channel 265.

When insert tray 250 is being mounted to carrier tray 104, a top surface 272 of lip 267 slides along and engages under surfaces of tracks 152 and 153. Front channel 265 is similar in construction to channel 165 and defined by components of main body 260, which slide along and engage top surfaces 176, 177 and 178 and under surfaces of tracks 154, 155 and 156.

Insert tray 250 also includes an indentation 280 (FIG. 11) in lip or leg 267. Indentation 280 is located at a midpoint along lip or leg 267 and is recessed a depth from the back of insert tray 250 into lip or leg 267. Indentation 280 is configured to mate with nub 159 on flexible tongue 158 of carrier tray 104. Upon insert tray 250 sliding along tracks 152, 153, 154, 155 and 156, the flexible nature of tongue 158 allows nub 159 to also ride along insert tray 250 until indentation 280 mates with nub 159 and locks insert tray 250 to carrier tray 104. To release insert tray 250, nub 159 and tongue 158 are depressed and insert tray 250 is again allowed to ride along tracks 152, 153, 154, 155 and 156 to be removed from carrier tray 104.

Label holder 262 is similar to label holder 162 of insert tray 150 in that label holder 262 is viewable at all times by a customer and includes label(s) 263 that relays price information. In addition, like label holder 162, label holder 262 also includes a back leg, a front leg and a connecting bottom piece that define a slot as well as spaced apart ramps for holding label(s) 263 in place. In accordance with some embodiments, label holder 262 is not a separate piece that is fastened to the front insert tray 250. Rather, label holder 262 is formed with main body 260 of insert tray 250 since both are made of a transparent material.

Figure 12:
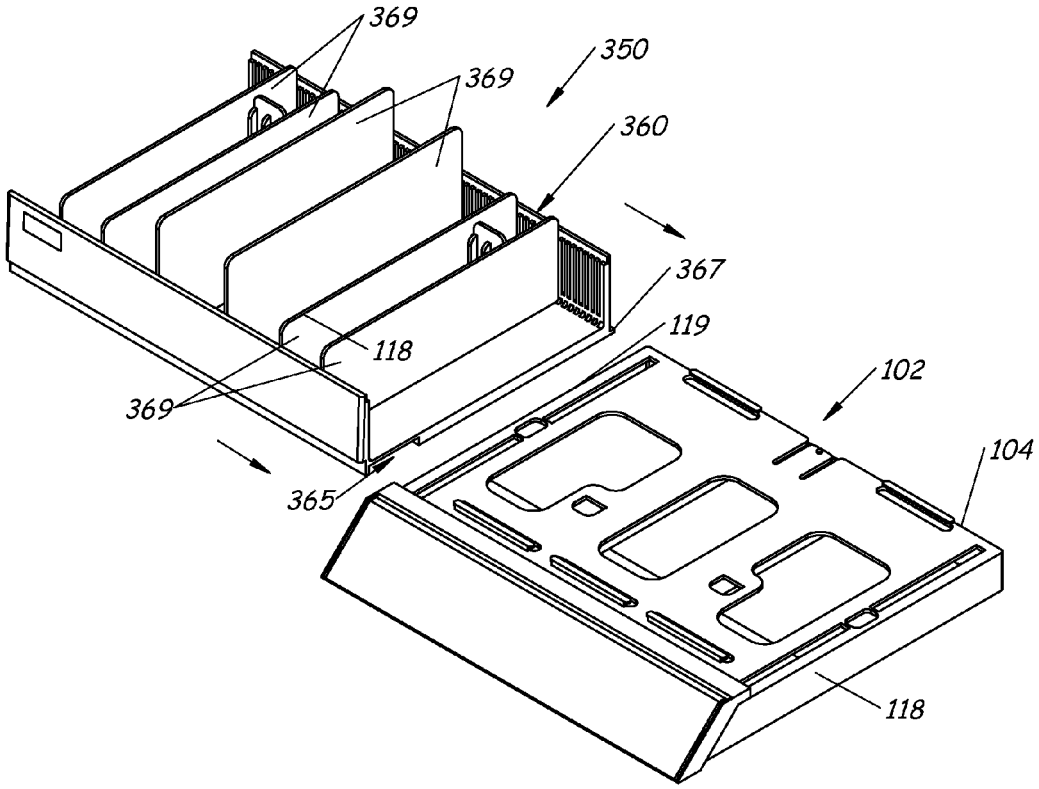
FIG. 12 is a perspective view of mounting yet another embodiment of an insert tray to the carrier tray assembly or base assembly illustrated in FIGS. 1 and 2.
Figure 13:
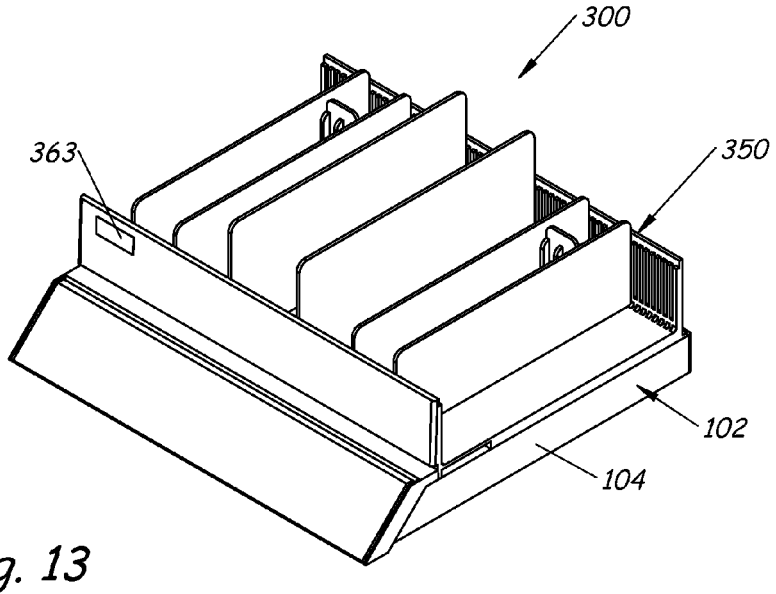
FIG. 13 is a perspective view of yet another embodiment of a shelf-type display module including the insert tray of FIG. 12 mounted to the carrier tray assembly or base assembly illustrated in FIGS. 1 and 2.

FIG. 12 illustrates a perspective view of mounting yet another embodiment of an insert tray 350 to carrier tray assembly 102. As illustrated in the FIG. 13 perspective view, after insert tray 350 is mounted to carrier tray assembly 102, the combination of carrier tray assembly 102 and insert tray 350 comprises a display fixture 300. As illustrated, insert tray 350 can be mounted to carrier tray assembly 102 by sliding insert tray 350 in the direction illustrated by arrows in FIG. 12. In other words, insert tray 350 can be mounted to carrier tray assembly 102 by sliding insert tray 350 from left side 119 to right side 118 on carrier tray 104. Although not specifically illustrated, in the alternative, insert tray 350 can be mounted to carrier tray assembly 102 by sliding insert tray 350 in a direction opposite of the directional arrows illustrated in FIG. 12. In other words, insert tray 350 can be mounted to carrier tray assembly 102 by sliding insert tray 350 from right side 118 to left side 119 on carrier tray 104.

Insert tray 350 is a utility tray and includes a main body 360 that can be fabricated by injection molding transparent styrene. Main body 360 includes components for holding products for display and for mating with tracks 152, 153, 154 and 156 on carrier tray 104. While insert tray 350 illustrates the utility tray having six removable dividers 369 for dividing the utility tray into seven rows, the utility tray can utilize any number of removable dividers for dividing the utility tray into any number of rows. Main body 360 includes a similar lip or leg 367 to lip or leg 267 of main body 260 of insert tray 250 including an indentation, such as indentation 280. Main body 360 also includes a front channel 365 that is similar to front channel 265 of main body 260. Like insert tray 250, when insert tray 350 is being mounted to carrier tray 104, a top surface of lip or leg 367 slides along and engages under surfaces of tracks 152 and 153. Front channel 365 is defined by components of main body 360, which slide along and engage top surfaces 176, 177 and 178 and under surfaces of tracks 154, 155 and 156. Likewise, the indentation in lip or leg 367 engages with nub 159 on flexible tongue 158 of carrier tray 104 to lock insert tray 350 to carrier tray 104 as well as similarly disengaging with nub 159 to unlock insert tray 350 from carrier tray 104.

Insert tray 350 like other configurations of utility trays includes a label holder 362. Label holder 362 is similar to label holder 162 of insert tray 150 and label holder 262 of insert tray 250 in that label holder 362 is viewable by a customer at all times and includes a label(s) 363 that relays price information to the customer. In addition, like label holders 162 and 262, label holder 362 also includes a back leg, a front leg and a connecting bottom piece that define a slot as well as spaced apart ramps for holding label(s) 363 in place. In accordance with some embodiments, label holder 362 is not a separate piece that is fastened to the front of insert tray 350. Rather, label holder 362, like label holder 262, is formed as a single piece with main body 360 of insert tray 350 since both are made of a transparent material.

Figure 14:
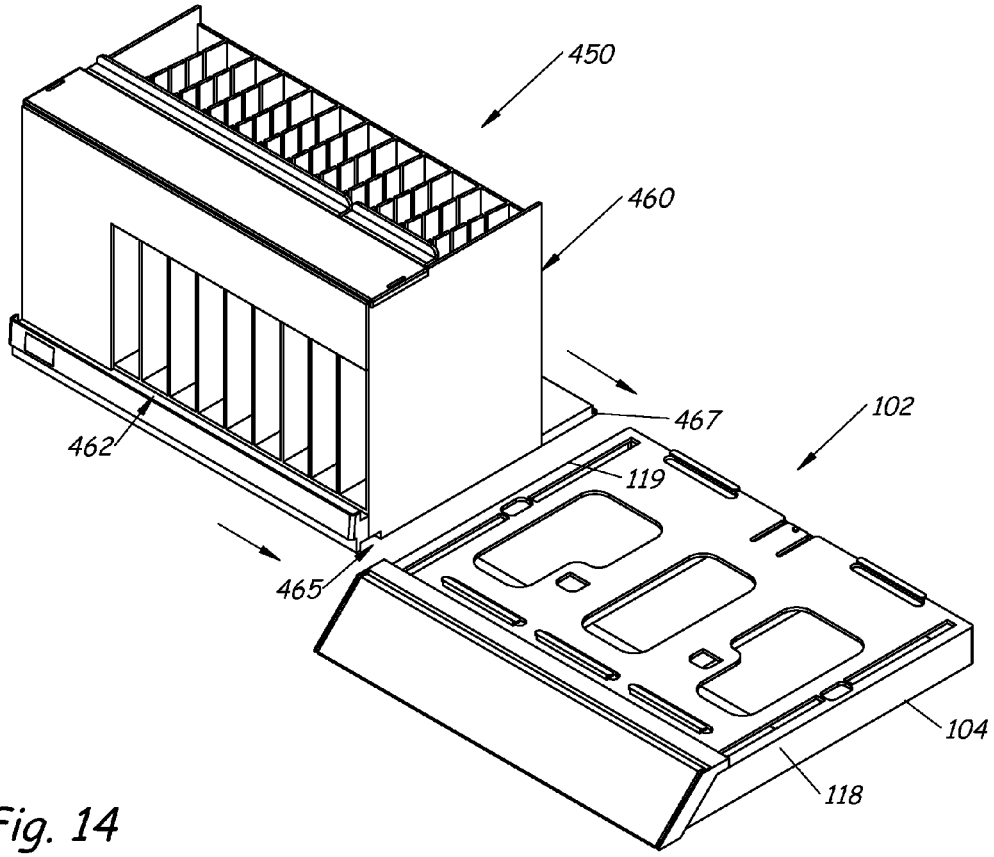
FIG. 14 is a perspective view of mounting yet another embodiment of an insert tray to the carrier tray assembly or base assembly illustrated in FIGS. 1 and 2.
Figure 15:
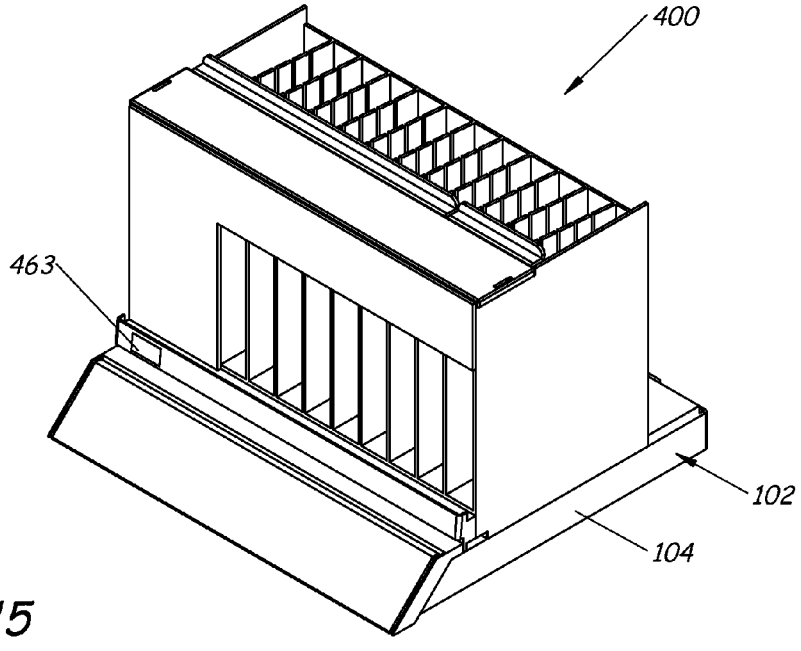
FIG. 15 is a perspective view of yet another embodiment of a shelf-type display module including the insert tray of FIG. 14 mounted to the carrier tray assembly or base assembly illustrated in FIGS. 1 and 2.

FIG. 14 illustrates a perspective view of mounting yet another embodiment of an insert tray 450 to carrier tray assembly 102. As illustrated in the FIG. 15 perspective view, after insert tray 450 is mounted to carrier tray assembly 102, the combination of carrier tray assembly 102 and insert tray 450 comprises a display fixture 400. As illustrated, insert tray 450 can be mounted to carrier tray assembly 102 by sliding insert tray 450 in the direction illustrated by arrows in FIG. 14. In other words, insert tray 450 can be mounted to carrier tray assembly 102 by sliding insert tray 450 from left side 119 to right side 118 on carrier tray 104. Although not specifically illustrated, in the alternative, insert tray 450 can be mounted to carrier tray assembly 102 by sliding insert tray 450 in a direction opposite of the directional arrows illustrated in FIG. 14. In other words, insert tray 450 can be mounted to carrier tray assembly 102 by sliding insert tray 450 from right side 118 to left side 119 on carrier tray 104.

Insert tray 450 is a cubby tray for holding product and includes a main body 460 that can be fabricated by injection molding transparent styrene. Main body 460 includes components for holding products for display and for mating with tracks 152, 153, 154, 155 and 156 on carrier tray 104. While insert tray 450 illustrates the cubby tray having twelve rows, the cubby tray can utilize any number of rows. Main body 460 includes a similar lip or leg 467 to lip or leg 267 of main body 260 of insert tray 250 including an indentation, such as indentation 280. Main body 460 also includes a front channel 465 that is similar to front channel 265 of main body 260. Like insert trays 250 and 350, when insert tray 450 is being mounted to carrier tray 104, a top surface of leg or lip 467 slides along and engages under surfaces of tracks 152 and 153. Front channel 465 is defined by components of main body 460, which slide along and engage top surfaces 176, 177 and 178 and under surfaces of tracks 154, 155 and 156. Likewise, the indentation in lip or leg 467 engages with nub 159 on flexible tongue 158 of carrier tray 104 to lock insert tray 450 to carrier tray 104 as well as similarly disengaging with nub 159 to unlock insert tray 450 from carrier tray 104.

Insert tray 450, like other configurations of cubby trays, includes a label holder 462. Label holder 462 is similar to label holder 162 of insert tray 150, label holder 262 of insert tray 250 and label holder 362 of insert tray 350 in that label holder 462 is viewable by a customer at all times and includes a label(s) 463 that relays price information to the customer. In addition, like label holders 162, 262 and 362, label holder 462 also includes a back leg, a front leg and a connecting bottom piece that define a slot as well as spaced apart ramps for holding label 463 in place. In accordance with some embodiments, label holder 462 is not a separate piece that is fastened to the front insert tray 450. Rather, label holder 462, like label holders 262 and 362, is formed as a single piece with main body 460 of insert tray 450 since both are made of a transparent material.

Figure 16:
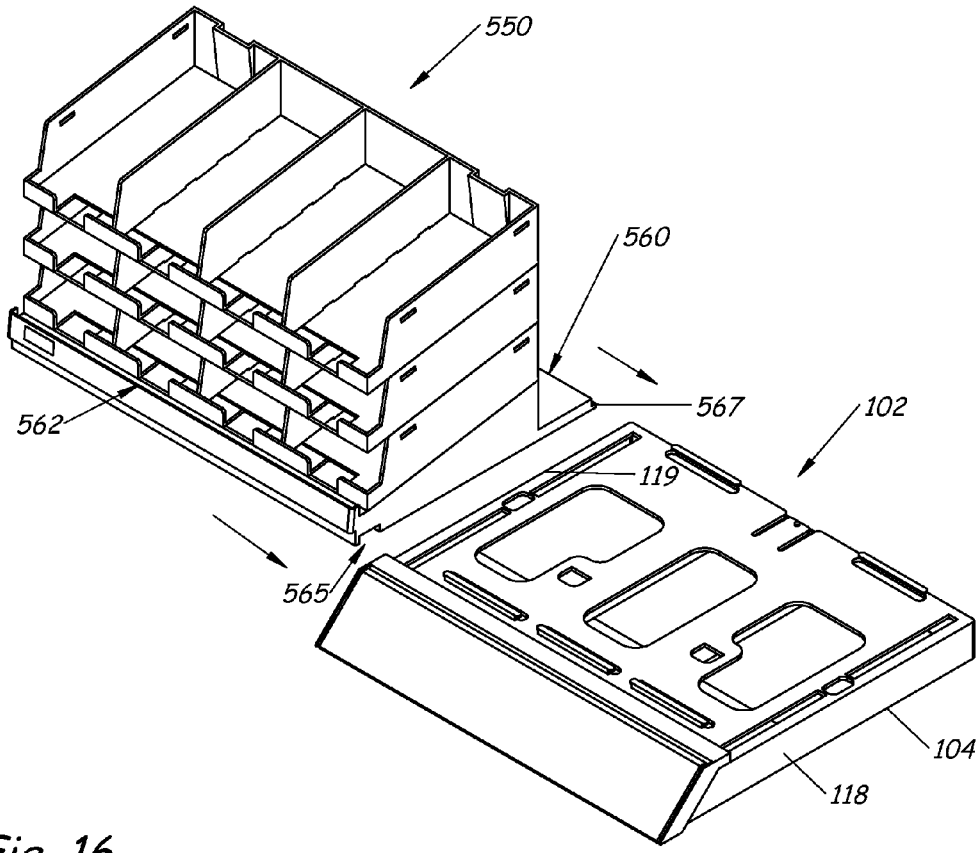
FIG. 16 is a perspective view of mounting yet another embodiment of an insert tray to the carrier tray assembly or base assembly illustrated in FIGS. 1 and 2.
Figure 17:
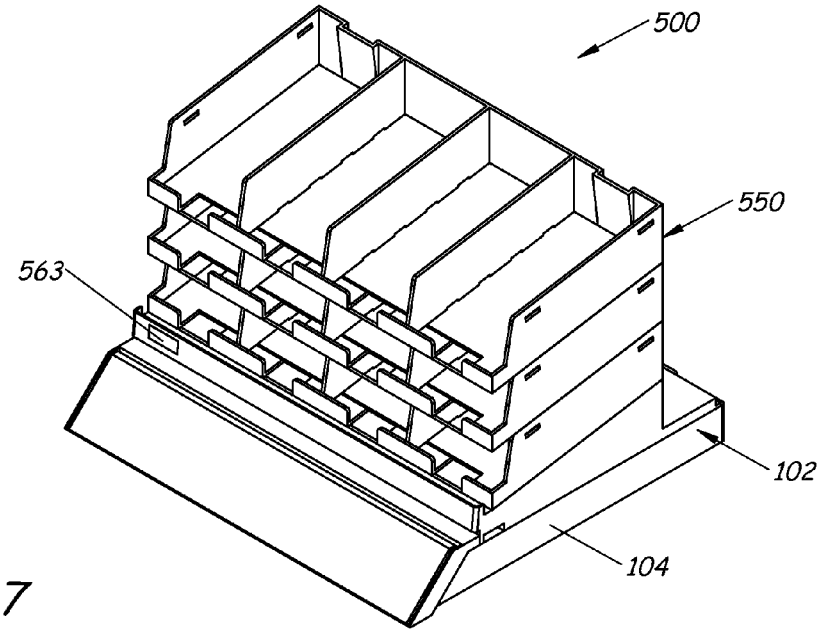
FIG. 17 is a perspective view of yet another embodiment of a shelf-type display module including the insert tray of FIG. 16 mounted to the carrier tray assembly or base assembly illustrated in FIGS. 1 and 2.

FIG. 16 illustrates a perspective view of mounting yet another embodiment of an insert tray 550 to carrier tray assembly 102. As illustrated in the FIG. 17 perspective view, after insert tray 550 is mounted to carrier tray assembly 102, the combination of carrier tray assembly 102 and insert tray 550 comprises a display fixture 500. As illustrated, insert tray 550 can be mounted to carrier tray assembly 102 by sliding insert tray 550 in the direction illustrated by arrows in FIG. 16. In other words, insert tray 550 can be mounted to carrier tray assembly 102 by sliding insert tray 550 from left side 119 to right side 118 on carrier tray 104. Although not specifically illustrated, in the alternative, insert tray 550 can be mounted to carrier tray assembly 102 by sliding insert tray 550 in a direction opposite of the directional arrows illustrated in FIG. 16. In other words, insert tray 550 can be mounted to carrier tray assembly 102 by sliding insert tray 550 from right side 118 to left side 119 on carrier tray 104.

Insert tray 550 is a gravity feed tray and includes a main body 560 that can be fabricated by injection molding transparent styrene. Main body 560 includes components for holding products for display and for mating with tracks 152, 153, 154, 155 and 156 on carrier tray 104. While insert tray 550 illustrates the gravity feed tray having four rows, the gravity feed tray can utilize any number of rows. Main body 560 includes a similar lip or leg 567 to main body 260 of insert tray 250, main body 360 of insert tray 350 and main body 460 of insert tray 450 including an indentation, such as indentation 280. Main body 560 also includes a front channel 365 that is similar to front channel 265 of main body 260. Like insert trays 250, 350 and 450, when insert tray 550 is being mounted to carrier tray 104, a top surface of lip or leg 567 slides along and engages under surfaces of tracks 152 and 153. Front channel 565 is defined by components of main body 560, which slide along and engage top surfaces 176, 177 and 178 and under surfaces of tracks 154, 155 and 156. Likewise, the indentation in lip 567 engages with nub 159 on flexible tongue 158 of carrier tray 104 to lock insert tray 550 to carrier tray 104 as well similarly disengaging with nub 159 to unlock insert tray 550 from carrier tray 104.

Insert tray 550, like other configurations of gravity feed trays, includes a label holder 562. Label holder 562 is similar to label holder 162 of insert tray 150, label holder 262 of insert tray 250, label holder 362 of insert tray 350 and label holder 462 of insert tray 460 in that label holder 562 is viewable by customers at all times and includes label(s) 563 that relays price information to the customer. In addition, like label holders 162, 262, 362 and 462, label holder 562 also includes a back leg, a front leg and a connecting bottom piece that define a slot as well as spaced apart ramps for holding label 563 in place. In accordance with some embodiments, label holder 562 is not a separate piece that is fastened to the front insert tray 550. Rather, label holder 562, like label holders 262, 362 and 462, is formed as a single piece with main body 560 of insert tray 550 since both are made of a transparent material.

Figure 18:
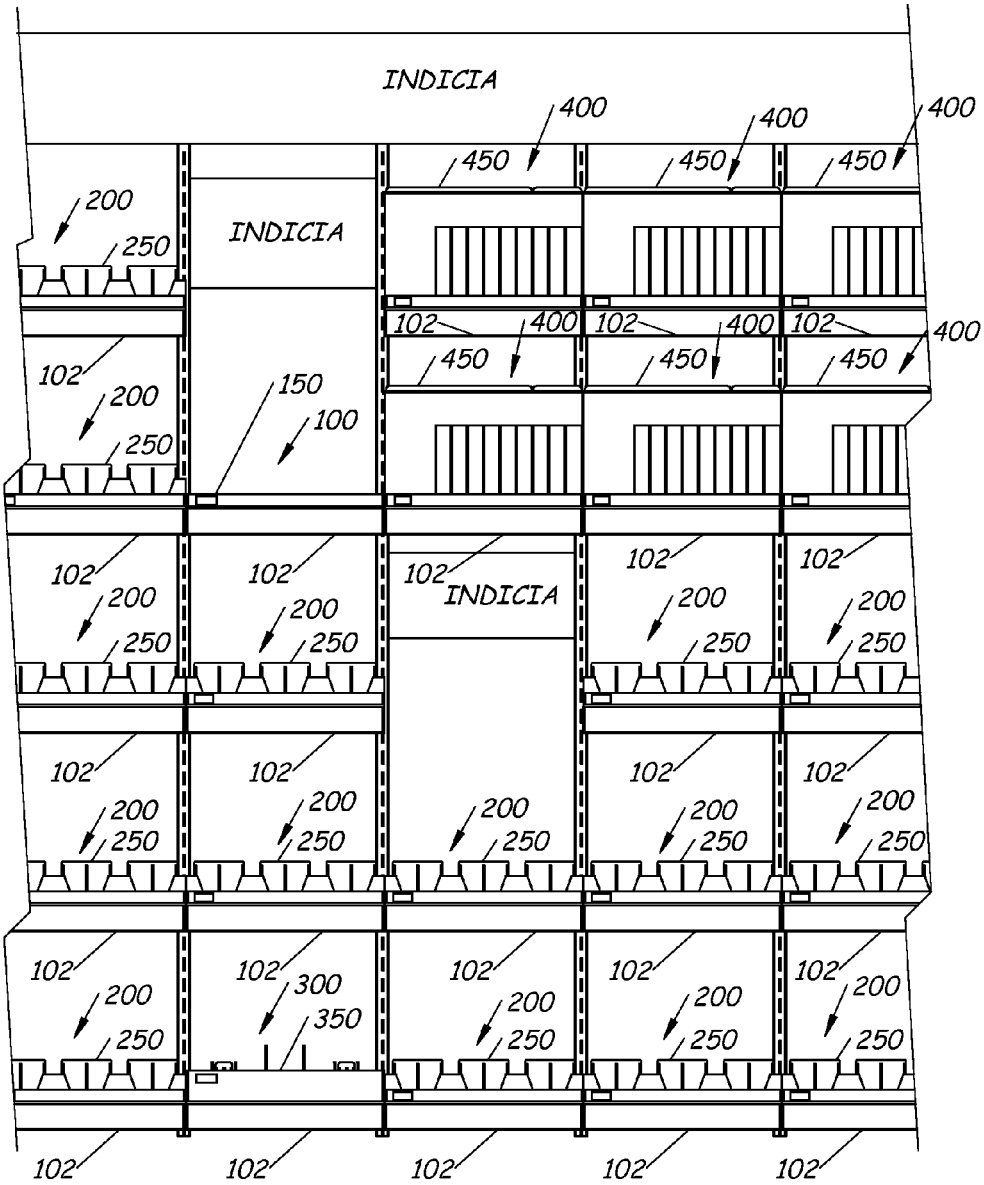
FIG. 18 is a front view of a display fixture including a plurality of shelf-type display modules mounted to uprights of a display unit in a retail store.

FIG. 18 is a front elevation view of a plurality of shelf-type display modules all mounted to concealed standards on a powered wall panel, which is coupled to a wall of a display unit, such as a gondola display unit. Exemplary shelf-type display modules include shelf-type display module 100 including carrier tray assembly 102 and insert tray 150, a plurality of shelf-type display modules 200 each including carrier tray assembly 102 and insert tray 250, shelf-type display module 300 including carrier tray assembly 102 and insert tray 350 and plurality of shelf-type display modules 400 each including carrier tray assembly 102 and insert tray 450. Together lights 112 in each carrier tray assembly 102 cast light downward to illuminate the display fixture for both highlighting products for purchase as well as highlighting labels in label holders that are viewable to the customer.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display module comprising:

a carrier tray assembly including a carrier tray having a top, a bottom, a plurality of tracks and at least one light, wherein the plurality of tracks protrude from the top of the carrier tray and wherein the at least one light is mounted to the bottom of the carrier tray; and an insert tray including a main body having components for holding products for display and components for mating with the plurality of tracks on the carrier tray, wherein the components of the main body that mate with the plurality of tracks on the carrier tray slide along the plurality of tracks from a right side to a left side of the carrier tray or from the left side to the right side of the carrier tray; and wherein the carrier tray assembly further includes a front assembly comprising:

a main body mounted to the front of the carrier tray;

a fanfold extrusion housed in the main body of the front assembly, the fanfold extrusion including at least two label sleeves for receiving labels that provide relevant information to employees about the products being supported by the carrier tray; and a cover rotatably coupled to the main body, the cover enclosing the fanfold extrusion within the main body.

2. The display module of claim 1, wherein the plurality of tracks protruding from the top of the carrier tray comprise a first set of tracks spaced apart from and in alignment with each other and a second set of tracks spaced apart from and in alignment with each other, the first set of tracks being located near a front of the carrier tray and the second set of tracks being located near a back of the carrier tray.

3. The display module of claim 2, wherein the components on the insert tray that mate with the plurality of tracks on the carrier tray comprise at least one leg that defines a first channel and at least one leg that defines a second channel, the at least one leg that defines a first channel slidably mates with the first set of tracks and the at least one leg that defines a second channel slidably mates with the second set of tracks.

4. The display module of claim 3 wherein the at least one leg that defines the first channel further defines a portion of a back of the insert tray.

5. The display module of claim 4, wherein the at least one leg that defines the first channel further comprises an indentation that is recessed from the back of the insert tray into the at least one leg, the indentation configured to engage with a nub that protrudes from a flexible tongue on the carrier tray so as to lock the insert tray to the carrier tray.

6. The display module of claim 3, wherein the first channel is defined by a first leg spaced apart from and located below a second leg, the first leg and the second leg slidably mating with the first set of tracks such that surfaces of the first leg contact surfaces on the first set of tracks and surfaces of the second leg contact different surfaces on the first set of tracks.

7. The display module of claim 1, wherein the insert tray is selected from a group consisting of a flat tray, a pusher tray including rows for holding product and mechanisms for pushing product forward, a utility tray including rows defined by removable dividers, a cubby tray and a gravity feed tray.

8. The display module of claim 1, wherein the insert tray comprises a label holder located at a front of the insert tray and extending a width of the insert tray, the label holder including a front component, a back component and a bottom connecting piece for defining a slot for receiving a label.

9. The display module of claim 8, wherein the label holder further comprises a plurality of ramps spaced apart from each other along the width of the insert tray, each ramp includes an arc that extends from an inner surface of the front component of the label holder to an inner surface of the bottom connecting piece of the label holder.

10. A display module comprising:

a carrier tray assembly including a carrier tray having a top, a bottom, a right side, a left side, a front, a back, a plurality of tracks, at least one light and a pair of shelf brackets, wherein each of the plurality of tracks protrudes from the top of the carrier tray, wherein the at least one light is mounted to the bottom of the carrier tray and wherein each of the pair of shelf brackets are mounted to an interior of each of the right side and the left side of the carrier tray and includes an arm that is hidden underneath the carrier tray and a plurality of fingers that extend from the back of the carrier tray; and an insert tray mounted to the top of the carrier tray and including a main body having components that hold products for display and components that mate with the plurality of tracks on the carrier tray, wherein the components of the main body that mate with the plurality of tracks on the carrier tray slide along the plurality of tracks from a right side to a left side of the carrier tray or from the left side to the right side of the carrier tray and wherein a right side of the insert tray is in alignment with the right side of the carrier tray and a left side of the insert tray is in alignment with the left side of the carrier tray when the insert tray is mounted to the carrier tray.

11. The display module of claim 10, wherein the carrier tray assembly further comprises a front assembly attached to the front of the carrier tray and including at least two label sleeves that receive labels that provide relevant information to employees about the products being supported by the carrier tray.

12. The display module of claim 11, wherein the front assembly comprises a main body that is mounted to the front of the carrier tray, the main body including an angled component that mates with an angle of the front of the carrier tray and an upper component having a top and a bottom, the bottom of the upper component of the main body mates with a portion of the top of the carrier tray.

13. The display module of claim 12, wherein the upper component of the main body of the front assembly comprises a transparent material.

14. The display module of claim 12, wherein the front assembly further comprises a fanfold extrusion housed in the main body of the front assembly, the fanfold extrusion including the at least two label sleeves.

15. The display module of claim 14, wherein the front assembly further comprises a cover rotatably coupled to the main body, the cover enclosing the fanfold extrusion within the main body.

16. A display module comprising:

a carrier tray assembly comprising:

a carrier tray having a top, a bottom, a right side, a left side, a front, a back, at least one first rail that protrudes from the top of the carrier tray and is located proximal to a back of the carrier tray, at least one second rail that protrudes from the top of the carrier tray and is located proximal to a front of the carrier tray;

a pair of shelf brackets mounted to an interior of the right and left sides of the carrier tray, each of the pair of shelf brackets including an armthat extends along a depth of the carrier tray and a plurality of fingers that extend from the back of the carrier tray;

at least one light mounted to the bottom of the carrier tray; and an insert tray having a main body that holds products for display and including a rear channel that extends along a back of the insert tray and a front channel that extends along at least a portion of a width of the insert tray, wherein the rear channel mates with the at least one first rail on the carrier tray and the front channel mates with the at least one second rail on the carrier tray such that the rear channel slides along the at least one first rail and the front channel slide along the at least one second rail from a right side to a left side of the carrier tray or from the left side to the right side of the carrier tray; and wherein a right side of the insert tray is in alignment with the right side of the carrier tray and a left side of the insert tray is in alignment with the left side of the carrier tray when the insert tray is mounted to the carrier tray.

17. The display module of claim 16, wherein the pair of shelf brackets comprise a conductive material such that the plurality of fingers both mechanically attach the carrier tray assembly and electrically connect to standards on a gondola display unit to power the at least one light mounted to the bottom of the carrier tray.

18. The display module of claim 16, wherein the at least one first rail comprises a plurality of first rails spaced apart from each other and in alignment with each other between the right side and the left side of the carrier tray and wherein the at least one second rail comprises a plurality of second rails spaced apart from each other and in alignment with each other between the right side and the left side of the carrier tray.

19. The display module of claim 16, wherein the carrier tray assembly further comprises a front assembly attached to the front of the carrier tray and including a main body, a fanfold extrusion that includes at least two label sleeves and a cover rotatably coupled to the main body and configured to cover the at least two label sleeves.

* * * * *